United States Patent [19]

Schwartz

[11] Patent Number: 4,786,583

[45] Date of Patent: Nov. 22, 1988

[54] STABILIZING BATH FOR USE IN PHOTOGRAPHIC PROCESSING

[75] Inventor: Paul A. Schwartz, Webster, N.Y.

[73] Assignee: Eastman Kodak Company, Rochester, N.Y.

[21] Appl. No.: 64,633

[22] Filed: Jun. 22, 1987

[51] Int. Cl.[4] ..... G03C 1/06; G03C 11/00; G03C 7/26; G03C 5/39

[52] U.S. Cl. ..... 430/372; 430/463; 430/486; 430/490; 430/493; 430/551; 430/607

[58] Field of Search ..... 430/372, 463, 557, 607, 430/486, 490, 493

[56] References Cited

U.S. PATENT DOCUMENTS

| | | | |
|---|---|---|---|
| 2,487,569 | 11/1949 | Mackey et al. | 430/372 |
| 2,518,686 | 8/1950 | Harsh et al. | 430/463 |
| 2,983,607 | 5/1961 | Clarke et al. | 430/372 |
| 3,369,896 | 2/1968 | Seemann et al. | 430/463 |
| 3,473,929 | 10/1969 | Jeffreys | 430/372 |
| 4,237,217 | 10/1980 | Arai et al. | 430/387 |
| 4,615,970 | 10/1986 | Kojima et al. | 430/372 |
| 4,618,569 | 10/1986 | Kurematsu et al. | 430/372 |

*Primary Examiner*—Mukund J. Shah
*Attorney, Agent, or Firm*—Alfred P. Lorenzo

[57] ABSTRACT

A stabilizing bath which provides reduced stain and enhanced dye stability for photographic color elements which are processed therein is comprised of a dye stabilizing agent and an alkanolamine. The stabilizing bath is used as a final processing bath which follows treatment of the element in a fixing or bleach-fixing bath containing a thiosulfate fixing agent. The alkanolamine functions to prevent the precipitation of sulfur resulting from carryover of the thiosulfate fixing agent into the stabilizing bath.

18 Claims, No Drawings

STABILIZING BATH FOR USE IN PHOTOGRAPHIC PROCESSING

FIELD OF THE INVENTION

This invention relates in general to color photography and in particular to methods and compositions for use in the processing of color photographic elements. More specifically, this invention relates to a novel stabilizing bath which is useful in photographic color processing to provide reduced stain and enhanced dye stability.

BACKGROUND OF THE INVENTION

Multicolor, multilayer photographic elements are well known in the art of color photography. Usually, these photographic elements have three different selectively sensitized silver halide emulsion layers coated on one side of a single support. The vehicle used for these emulsion layers is normally a hydrophilic colloid, such as gelatin. One emulsion layer is blue-sensitive, another green-sensitive and another red-sensitive. Although these layers can be arranged on a support in any order, they are most commonly arranged with the support coated in succession with the red-sensitive layer, the green-sensitive layer and the blue-sensitive layer (advantageously) with a bleachable blue-light-absorbing filter layer between the blue-sensitive layer and the green-sensitive layer) or with the opposite arrangement and no filter layer. Colored photographic images are formed from latent images in the silver halide emulsion layers during color development by the coupling of oxidized aromatic primary amine color developing agent with couplers present either in the color developer solution or incorporated in the appropriate light-sensitive layers. Color photographic elements containing dye images usually utilize a phenolic or naphtholic coupler that forms a cyan dye in the red-sensitive emulsion layer, a pyrazolone or cyanoacetyl derivative coupler that forms a magenta dye in the green-sensitive emulsion layer and an acetylamide coupler that forms a yellow dye in the blue-sensitive emulsion layer. Diffusible couplers are used in color developer solutions. Non-diffusing couplers are incorporated in photographic emulsion layers. When the dye image formed is to be used in situ, couplers are selected which form non-diffusing dyes. For image transfer color processes, couplers are used which will produce diffusible dyes capable of being mordanted or fixed in the receiving sheet.

It is well known in the photographic art to utilize a stabilizing bath as the final step in the processing of both color films and color papers. Such baths can serve to reduce stain and/or enhance dye stability. A wide variety of different stabilizing compositions have been proposed for such use. Thus, the known stabilizing baths include those containing addition products of formaldehyde and a diazine or triazine as described in Mackey et al, U.S. Pat. No. 2,487,569 issued Nov. 8, 1949; aliphatic aldehydes as described in Harsh et al, U.S. Pat. No. 2,518,686 issued Aug. 15, 1950; addition products of formaldehyde and a urea, as described in Mackey, U.S. Pat. No. 2,579,435 issued Dec. 18, 1951; tetramethylol cyclic alcohols or ketones as described in Clarke et al, U.S. Pat. No. 2,983,607 issued May 9, 1961; glucoheptonates as described in Bard, U.S. Pat. No. 3,157,504 issued Nov. 17, 1964; amino acids as described in Jeffreys, U.S. Pat. No. 3,291,606 issued Dec. 13, 1966; mixtures of an aldehyde and an alkoxy-substituted polyoxyethylene compound as described in Seemann et al, U.S. Pat. No. 3,369,896 issued Feb. 20, 1968; compounds comprising a tri(hydroxymethyl)methyl group as described in Jeffreys et al, U.S. Pat. No. 3,473,929 issued Oct. 21, 1969; and addition complexes of an alkali metal bisulfite and an aldehyde as described in Mowrey, U.S. Pat. No. 3,676,136 issued July 11, 1972.

The formation of yellow stain in photographic color elements is believed to be related to the presence of unreacted coupler in emulsion layers and to be influenced by a number of factors such as heat, humidity, conditions to which the photographic element was subject in development, e.g., development time, temperature and replenishment rate, the contamination of developing composition, such as contamination by bleaching agents, and so forth. Dye stability is believed to also be affected by the presence of unreacted coupler in emulsion layers (since coupler and dye can react slowly with one another to degrade a color image) and to be influenced by such factors as temperature, humidity, ambient oxygen, and the spectral distribution and intensity of the light to which the dye image is subjected. Magenta dye stability is a particular problem, as the magenta dye image tends to fade much more rapidly than either the cyan dye image or the yellow dye image. Thus, the problems of stain formation and dye stability are interrelated and highly complex, and the stabilizing compositions known heretofore have typically been deficient in one or more respects as regards the overcoming of these problems.

Processes which are intended for rapid access processing of photographic color elements pose a particular difficulty with respect to the provision of an effective stabilizing bath. In order to shorten the total processing time, such processes typically do not have a wash step following the fixing or bleach-fixing step and, in consequence, the element passes directly from the fixing or bleach-fixing bath into the stabilizing bath. This results in carryover of the fixing agent, which is usually a thiosulfate, into the stabilizing bath. The result of such carryover is decomposition of the thiosulfate and precipitation of elemental sulfur in the stabilizing bath with resultant fouling of both the processing apparatus and the photographic element. This problem is commonly referred to as "sulfurization" of the stabilizing bath.

It is toward the objective of providing a novel stabilizing bath that is highly effective in reducing yellow stain formation and increasing dye stability, and which eliminates or greatly reduces the tendency for sulfurization to occur, that the present invention is directed.

SUMMARY OF THE INVENTION

In accordance with this invention, a novel stabilizing composition is utilized to provide improved dye stability to photographic color elements which are comprised of a support having thereon at least one hydrophilic colloid layer containing a dye image. The stabilizing composition comprises an aqueous solution of a dye stabilizing agent and an alkanolamine. The stabilizing composition can be applied to the photographic element in any suitable manner, such as by its use as the final processing step of a conventional photographic process, i.e., the step which immediately precedes the drying step. It provides reduced stain and improved dye stability and by virtue of the presence of the alkanolamine— which functions in a manner whose mechanism is not clearly understood—is strongly resistant to sulfurization.

DESCRIPTION OF THE PREFERRED EMBODIMENTS

The stabilizing composition of this invention can be used to provide improved dye stability with any of a wide variety of color photographic elements. Thus, for example, the stabilizing composition can be advantageously employed in the processing of photographic elements designed for reversal color processing or in the processing of negative color element or color print materials. The stabilizing composition can be employed with photographic elements which are processed in color developers containing couplers or with photographic elements which contain the coupler in the silver halide emulsion layers or in layers contiguous thereto. The photosensitive layers present in the photographic elements processed according to the method of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, paper, polymer-coated paper, and the like.

The photographic elements which are advantageously treated with the stabilizing composition of this invention are elements comprising a support having thereon at least one, and typically three or more, hydrophilic colloid layers containing a dye image. Any of a wide variety of colloids can be utilized in the production of such elements. Illustrative examples of such colloids include naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like.

In the production of color photographic images, it is necesssary to remove the silver image, which is formed coincident with the dye image. This can be done by oxidizing the silver by means of a suitable oxidizing agent, commonly referred to as a bleaching agent, in the presence of halide ion followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

Color print papers are most commonly processed by use of a bleach-fixing solution. Color negative films are most commonly processed by use of separate bleaching and fixing solutions. The bleaching agent is typically a ferric complex of an aminopolycarboxylic acid, for example, the ferric complex of ethylenediaminetetraacetic acid (EDTA) or the ferric complex of 1,3-propylenediaminetetraacetic acid (PDTA) or a mixture of the ferric complex of EDTA and the ferric complex of PDTA. The fixing agent is typically a thiosulfate, such as sodium thiosulfate or ammonium thiosulfate, or a thiocyanate, such as ammonium thiocyanate, or a mixture of a thiosulfate and a thiocyanate.

Processes employing the stabilizing composition of this invention can vary widely in regard to the particular processing steps utilized. For example, the process can comprise only the two steps of color developing and bleach-fixing, followed by the stabilizing step, or it can comprise the three steps of color developing, bleaching, and fixing, followed by the stabilizing step. Alternatively, it can be a color reversal process in which the processing baths utilized are a first developer, a reversal bath, a color developer, a bleach, and a fix, followed by the stabilizing bath.

Any of the well known dye stabilizing agents known to be useful in photographic color processing can be employed in the stabilizing baths of this invention. Particularly useful dye stabilizing agents include hexamethylenetetramine, aliphatic aldehydes such as formaldehyde, paraformaldehyde, acetaldehyde, aldol, crotonaldehyde, propionaldehyde, and the like, and N-methylol compounds such as dimethylol urea
trimethylol urea
dimethylol guanidine
trimethylol melamine
tetramethylol melamine
pentamethylol melamine
hexamethylol melamine
1,3-dimethylol-5,5-dimethyl hydantoin
and the like.

In addition to the dye stabilizing agent, the stabilizing baths of this invention contain an alkanolamine. The use of alkanolamines in such baths is based on the unexpected discovery that they function effectively to retard sulfurization and thereby make it feasible to tolerate the carry-in of thiosulfate fixing agent that occurs in processes that do not use a wash step after the fixing or bleach-fixing step. The mechanism whereby the alkanolamine causes this result is not clearly understood.

The term "alkanolamine", as used herein, refers to an amine in which the nitrogen atom is directly attached to a hydroxyalkyl group, i.e., the amine comprises an >N—X—OH group where X is alkylene. The radicals attached to the free bonds in the >N—X—OH group can be hydrogen atoms or organic radicals, e.g., unsubstituted hydrocarbon radicals or substituted hydrocarbon radicals. They are preferably hydrocarbyl radicals of 1 to 12 carbon atoms, for example, alkyl, aryl, alkaryl or aralkyl radicals.

Alkanolamines which are preferred for use in the stabilizing baths of this invention are compounds of the formula:

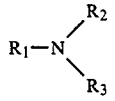

wherein $R_1$ is an hydroxyalkyl group of 2 to 6 carbon atoms and each of $R_2$ and $R_3$ is a hydrogen atom, an alkyl group of 1 to 6 carbon atoms, an hydroxylalkyl group of 2 to 6 carbon atoms, a benzyl radical, or a

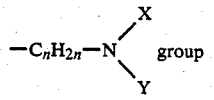

wherein n is an integer of from 1 to 6 and each of X and Y is a hydrogen atom, an alkyl group of 1 to 6 carbon atoms or an hydroxylalkyl group of 2 to 6 carbon atoms. Alkanolamines which are especially preferred are compounds of the formula:

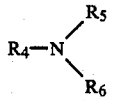

wherein $R_4$ is an hydroxyalkyl group of 2 to 4 carbon atoms and each of $R_5$ and $R_6$ is an alkyl group of 1 to 4 carbon atoms or an hydroxyalkyl group of 2 to 4 carbon atoms. Typical examples of alkanolamines which can be used in the stabilizing baths of this invention include:

ethanolamine
diethanolamine
triethanolamine
di-isopropanolamine
2-methylaminoethanol
2-ethylaminoethanol
2-dimethylaminoethanol
2-diethylaminoethanol
1-diethylamino-2-propanol
3-diethylamino-1-propanol
3-dimethylamino-1-propanol
isopropylaminoethanol
3-amino-1-propanol
2-amino-2-methyl-1,3-propanediol
ethylenediamine tetraisopropanol
benzyldiethanolamine
2-amino-2-(hydroxymethyl)-1,3-propandiol
and the like.

Other additives can also be incorporated in the stabilizing bath with beneficial results. Examples of useful additives include wetting agents, buffering agents and biocides. Wetting agents are particularly useful when processing color negative films to avoid water spotting. Organosiloxane wetting agents are especially beneficial and their stability in the stabilizing bath of this invention is enhanced by the presence of the alkanolamine. Biocides are useful to prevent microbial growth in both processes for color films and processes for color papers. A particularly useful class of biocides for this purpose are the thiazole compounds, especially isothiazolines such as 1,2-benzisothiazolin-3-one, 2-methyl-4-isothiazolin-3-one, 2-octyl-4-isothiazolin-3-one and 5-chloro-N-methyl-4-isothiazolin-3-one.

The ingredients utilized in making up the stabilizing composition of this invention can be used in any suitable amount and the optimum amount of each will vary widely depending on a number of factors such as the particular compounds employed, the manner of treating the photographic element with the stabilizing composition, and the particular type of photographic element which is to be treated.

Typically, the dye stabilizing agent is used in an amount of from about 0.1 to about 10 grams per liter of stabilizing solution, and more preferably in an amount of from about 0.4 to about 2 grams per liter, and the alkanolamine is used in an amount of from about 0.5 to about 20 grams per liter of stabilizing solution, and more preferably in an amount of from about 1 to about 5 grams per liter. The stabilizing solution is preferably employed at a pH in the range of from about 6 to about 10, and more preferably at a pH in the range of from 7 to 9.

Application of the stabilizing composition to a photographic element is conveniently accomplished by immersion of the element in the stabilizing bath but can be carried out by other means such as surface application. The time and temperature employed for the stabilization treatment can vary widely. For example, suitable times are typically in the range of from about 0.1 to about 3 minutes, more preferably from about 0.5 to about 1.5 minutes, while suitable temperatures are typically in the range of from about 20° C. to about 50° C., more preferably from about 30° C. to about 40° C. While the stabilizing bath of this invention to typically used as the final bath in the photographic processing cycle, it can also be used as a post-processing treatment. For example, it could be used to treat processed elements in which the dye images have already begun to deteriorate, in order to reduce further deterioration.

The invention is further illustrated by the following examples.

EXAMPLE 1

In order to evaluate the propensity for sulfurization to occur, an aqueous stabilizing bath within the scope of the present invention, designated bath A, was prepared and stored in a closed glass jar at 50° C. For purposes of comparison, control baths I and II were stored under identical conditions. Bath A contained 1.25 milliliters per liter of formalin (a 37% by weight solution of formaldehyde) and 2 grams per liter of triethanolamine. Control bath I contained 1.25 milliliters per liter of formalin. Control bath II contained 4 milliliters per liter of formalin.

To simulate carryover of fixing composition into the stabilizing bath, as occurs in processes that do not employ wash steps, a fixing bath was added to the stabilizing bath in amounts as indicated below. The fixing bath had a pH of 6.50 and contained the following ingredients:

| | grams/liter |
|---|---|
| $(NH_4)_2S_2O_3$ (58% solution) | 214.3 |
| $Na_2S_2O_5$ | 12.8 |
| Disodium EDTA | 1.29 |

The amount of fixing composition added to the stabilizing baths and the time required for sulfurization to occur are summarized in the following table:

| | Milliliters of fixing composition/liter of stabilizer | | | |
|---|---|---|---|---|
| | 0 | 1 | 3 | 10 |
| Stabilizing Bath | Time to Sulfurize (days) | | | |
| Bath A | >60 | >60 | >60 | >60 |
| Control Bath I | >60 | 29 | 10 | 5 |
| Control Bath II | >60 | 14 | 1 | 0.5 |

As indicated by the above data, bath A, which contained triethanolamine in accordance with the present invention, did not sulfurize within 60 days even when fixing composition was added in an amount of as much as 10 milliliters per liter. In contrast, control baths I and II, which contained only formaldehyde, sulfurized within a few days when fixing composition was present in substantial amounts.

EXAMPLE 2

Stabilizing bath A of Example 1 and control baths I and II of Example 1 were tested for sulfurization by storing them in closed glass jars in dark storage at 44° C. Tests were carried out with no fixing composition added and with the addition of 20 milliliters of fixing composition per liter of stabilizer. In addition, stabilizing baths B and C and control bath III were evaluated in the same manner. The composition of these baths was as follows:

| | |
|---|---|
| Bath B | |
| Formalin | 1.25 mL/L |
| Triethanolamine | 2.0 g/L |
| Wetting agent | 1.0 mL/L |
| Biocide* | 1.6 mL/L |
| Bath C | |
| Formalin | 1.25 mL/L |
| Triethanolamine | 2.0 g/L |
| Wetting agent | 1.0 mL/L |
| 1,2-Benzisothiazolin-3-one (17% solution) | 0.14 g/L |
| Control Bath III | |
| Formalin | 1.25 mL/L |
| Wetting agent | 1.0 mL/L |
| Biocide* | 1.6 mL/L |

*A mixture of about three parts by weight 5-chloro-N—methyl-4-isothiazolin-3-one and one part by weight N—methyl-4-isothiazolin-3-one.

The amount of fixing composition added to the stabilizing baths and the time required for sulfurization to occur are summarized in the following table:

| | Time to Sulfurize (days) | |
|---|---|---|
| | No Fixing Composition added | 20 milliliters of fixing composition added per liter of stabilizing bath |
| Bath A | >56 | >56 |
| Bath B | >56 | >56 |
| Bath C | >56 | >56 |
| Control bath I | >56 | 0.67 |
| Control bath II | >56 | 0.67 |
| Control bath III | >56 | 0.67 |

As indicated by the above data, baths A, B and C, each of which contained triethanolamine, did not sulfurize within 56 days whether or not fixing composition was added. In constrast, when fixing composition was added, all three of the control baths sulfurized in less than one day. The incorporation of wetting agents and biocides in the stabilizing baths did not have any significant effect on the tendency to sulfurize.

The invention has been described in detail with particular reference to preferred embodiments thereof, but it will be understood that variations and modifications can be effected within the spirit and scope of the invention.

I claim:

1. An aqueous photographic stabilizing bath for use in the color processing of photographic elements, said bath containing a dye stabilizing agent and an alkanolamine, said alkanolamine being present in an amount sufficient to inhibit sulfurization of said stabilizing bath resulting from carry-in of a thiosulfate fixing agent.

2. A stabilizing bath as claimed in claim 1 wherein said dye stabilizing agent is hexamethylenetetramine.

3. A stabilizing bath as claimed in claim 1 wherein said dye stabilizing agent is an N-methylol compound.

4. A stabilizing bath as claimed in claim 1 wherein said dye stabilizing agent is an aliphatic aldehyde.

5. A stabilizing bath as claimed in claim 1 wherein said dye stabilizing agent is formaldehyde.

6. A stabilizing bath as claimed in claim 1 wherein said alkanolamine has the formula:

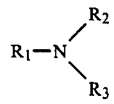

wherein $R_1$ is an hydroxyalkyl group of 2 to 6 carbon atoms and each of $R_2$ and $R_3$ is a hydrogen atom, an alkyl group of 1 to 6 carbon atoms, an hydroxylalkyl group of 2 to 6 carbon atoms, a benzyl radical, or a

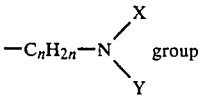

wherein n is an integer of from 1 to 6 and each of X and Y is a hydrogen atom, an alkyl group of 1 to 6 carbon atoms or an hydroxylalkyl group of 2 to 6 carbon atoms.

7. A stabilizing bath as claimed in claim 1 wherein said alkanolamine has the formula:

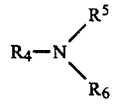

wherein $R_4$ is an hydroxyalkyl group of 2 to 4 carbon atoms and each of $R_5$ and $R_6$ is an alkyl group of 1 to 4 carbon atoms or an hydroxyalkyl group of 2 to 4 carbon atoms.

8. A stabilizing bath as claimed in claim 1 wherein said alkanolamine is triethanolamine.

9. An aqueous photographic stabilizing bath for use in the color processing of photographic elements, said bath containing formaldehyde in an amount sufficient to improve dye stability of said photographic element and triethanolamine in an amount sufficient to inhibit sulfurization of said stabilizing bath resulting from carry-in of a thiosulfate fixing agent.

10. In a method for processing a silver halide photographic color element comprising the steps of treating said element in succession with a color developing solution, a bleach-fixing solution or separate bleaching and fixing solutions, and a stabilizing solution; said fixing or bleach-fixing solution containing a thiosulfate fixing agent which is carried by said element into said stabilizing solution; the improvement wherein said stabilizing solution contains a dye stabilizing agent and a sufficient amount of an alkanolamine to retard decomposition of said thiosulfate and resulting sulfurization of said stabilizing solution.

11. A method as claimed in claim 10 wherein said dye stabilizing agent is hexamethylenetetramine.

12. A method as claimed in claim 10 wherein said dye stabilizing agent is an N-methylol compound.

13. A method as claimed in claim 10 wherein said dye stabilizing agent is an aliphatic aldehyde.

14. A method as claimed in claim 10 wherein said dye stabilizing agent is formaldehyde.

15. A method as claimed in claim 10 wherein said alkanolamine has the formula:

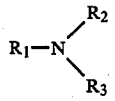

wherein $R_1$ is an hydroxyalkyl group of 2 to 6 carbon atoms and each of $R_2$ and $R_3$ is a hydrogen atom, an alkyl group of 1 to 6 carbon atoms, an hydroxyalkyl group of 2 to 6 carbon atoms, a benzyl radical, or a

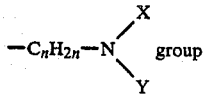

wherein n is an integer of from 1 to 6 and each of X and Y is a hydrogen atom, an alkyl group of 1 to 6 carbon atoms or an hydroxylalkyl group of 2 to 6 carbon atoms.

16. A method as claimed in claim 10 wherein said alkanolamine has the formula:

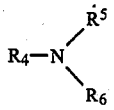

wherein $R_4$ is an hydroxyalkyl group of 2 to 4 carbon atoms and each of $R_5$ and $R_6$ is an alkyl group of 1 to 4 carbon atoms or an hydroxyalkyl group of 2 to 4 carbon atoms.

17. A method as claimed in claim 10 wherein said alkanolamine is triethanolamine.

18. In a method for processing a silver halide photographic color element comprising the steps of treating said element in succession with a color developing solution, a bleach-fixing solution or separate bleaching and fixing solutions, and a stabilizing solution; said fixing or bleach-fixing solution containing a thiosulfate fixing agent which is carried by said element into said stabilizing solution; the improvement wherein said stabilizing solution contains formaldehyde in an amount sufficient to serve as a dye stabilizing agent and triethanolamine in an amount sufficient to retard decomposition of said thiosulfate and resulting sulfurization of said stabilizing solution.

* * * * *